United States Patent [19]

Price

[11] 4,368,601

[45] Jan. 18, 1983

[54] GUTTER IMPROVEMENT

[76] Inventor: Harry A. Price, 14906 Kildare, Midlothian, Ill. 60445

[21] Appl. No.: 176,533

[22] Filed: Aug. 8, 1980

[51] Int. Cl.[3] ..... E04D 13/08

[52] U.S. Cl. ..... 52/16; 52/12

[58] Field of Search ..... 52/11–16

[56] References Cited

U.S. PATENT DOCUMENTS

| | | | |
|---|---|---|---|
| 248,328 | 10/1881 | Kaltenbach | 52/61 |
| 939,838 | 11/1909 | Hensler | 52/12 |
| 4,028,895 | 6/1977 | Franzmeier | 52/16 |
| 4,150,515 | 4/1979 | Giulini | 52/12 |
| 4,194,325 | 3/1980 | Chalpin | 52/14 |

*Primary Examiner*—Price C. Faw, Jr.
*Assistant Examiner*—Henry E. Raduazo
*Attorney, Agent, or Firm*—John Vander Weit, Jr.

[57] ABSTRACT

A device for use with guttering, troughs and downspouts which collects water and blocking debris, including a channel open at one end including a chute portion and a pair of side walls capable of being attached to a trough so that the chute portion is aligned with the bottom of the trough and the chute portion slopes downward and away from the trough at its attachment to the trough and the pair of side walls are connected to the front wall of the trough so as to allow water to flow from the trough to the channel, and an outlet located in the chute portion of the channel capable of conducting water from the channel to a downspout, the outlet being displaced between the trough side of the channel and the open end of the channel, wherein the channel and the outlet when used in guttering between a trough and a downspout allow water to be collected by a trough, flow to the channel, flow down the chute, flow into the outlet and then flow through a downspout, while also allowing blocking debris to pass through the channel, over the chute, over the outlet and out the open end of channel while bypassing a downspout.

13 Claims, 2 Drawing Figures

GUTTER IMPROVEMENT

BACKGROUND OF THE INVENTION

This invention relates generally to guttering and more particularly concerns an improvement to guttering which helps alleviate the problem of blockage of troughs and downspouts. As many home owners well know, in most guttering, the biggest problem is blocking debris such as leaves, twigs, fruits, seeds, balls, and the like. This debris is often gathered in the trough portion of the guttering over the downspout opening which causes blockage of the downspout. When the downspout openings are blocked, the guttering either only partially fulfills its purpose or in bad cases totally fails and allows water to overrun the trough. This necessitates cleaning of the troughs and downspouts which can be quite a tiresome and dangerous chore.

While people have tried a variety of devices to keep blocking debris from entering the trough, such as screens or other grid work placed on top of the trough, if blocking debris passes through the trough at any place or after a period of time, such screens make cleaning the guttering system even more difficult.

Accordingly, it is an object of this invention to provide an improved device which will allow blocking debris to be removed from the troughs and guttering by being washed out during water collection by the guttering.

SUMMARY OF THE INVENTION

In accordance with the invention, there is provided a device for use with a trough and downspout comprising a channel which is affixed at its upper end to the side of a trough and which is affixed at its lower surface to the top of a downspout, the channel further including an upper opening at the channel's upper end which is suitable for allowing drainage of the trough so that the lowest surface of the trough may drain into the channel, a lower opening at the channel's lower end which allows drainage other than through a downspout from substantially the lowest surface of the channel, and an outlet for the downspout interposed between said upper and lower openings which allows drainage into a downspout.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
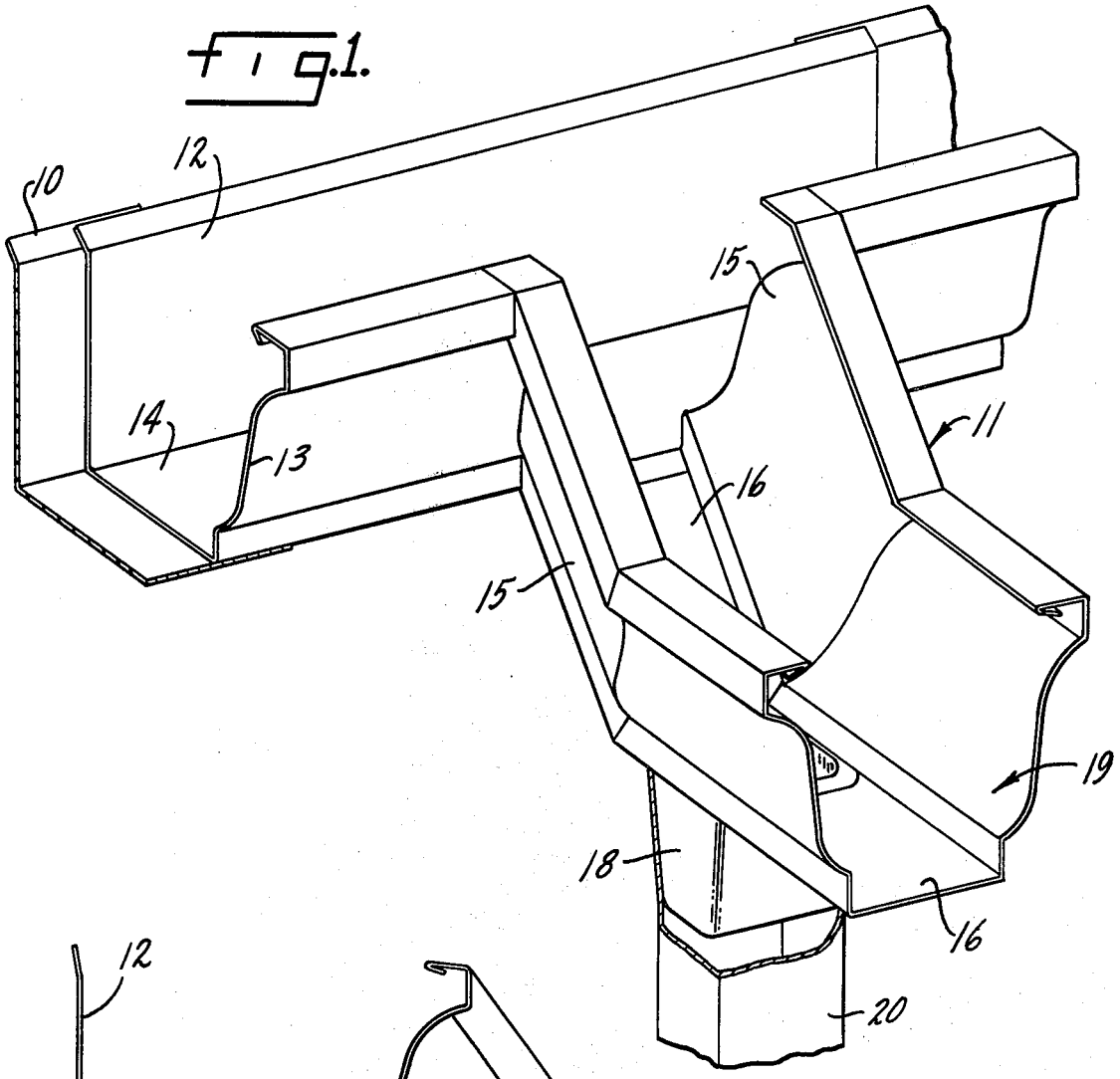
FIG. 1 is a perspective view of a device constructed in accordance with the embodiments of the instant invention; and, FIG. 2 is a side fragmentary view of the device shown in FIG. 1.
Figure 2:
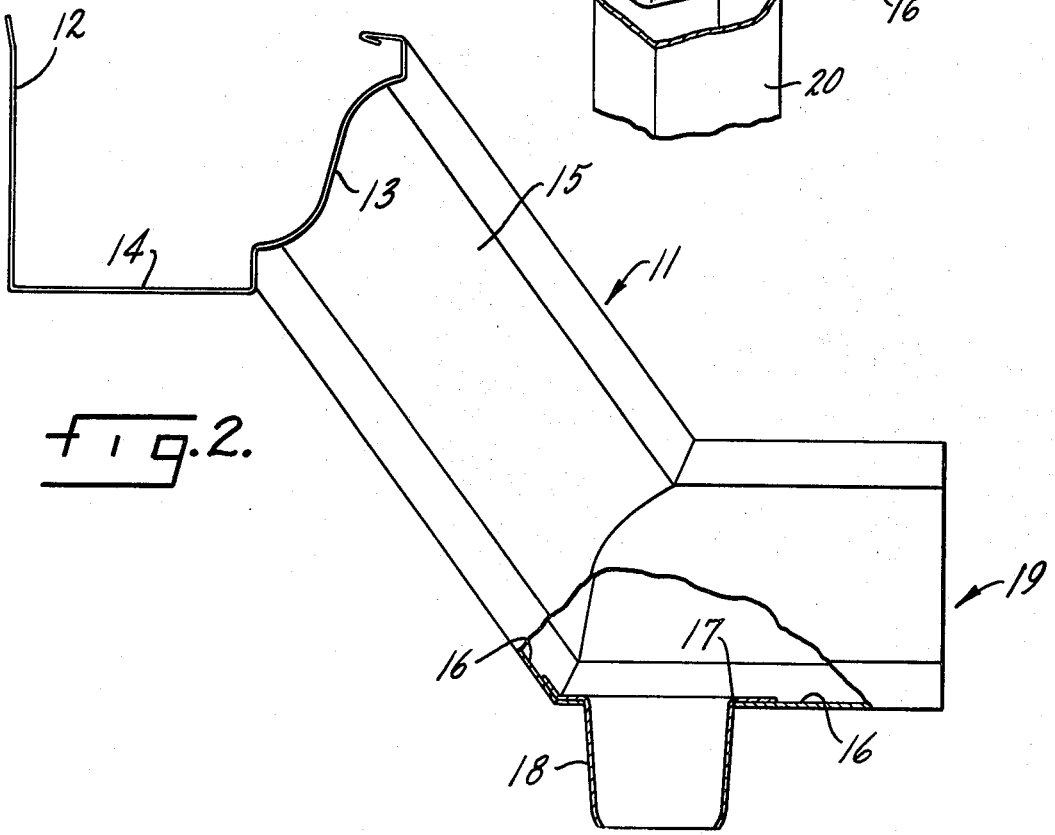

Turning first to FIG. 1, there is shown a trough 10 which is typically found in guttering in both residential and commercial structures. Also shown is a channel 11 which is constructed in accordance with the instant invention. Trough 10 may be any of the suitable water conveying channels or conduits which are normally placed at or under the eaves of roofs of structures. Back wall 12 of trough 11 is affixed in some manner to the structure so as to allow water to drain from the roof into trough 10. Front wall 13 of trough 10 forms a channel with back wall 12 and bottom wall 14 which provides for conveyance of water through trough 10. Channel 11 includes side walls 15 which are affixed to front wall 13 of trough 10. Channel 11 also includes chute portion 16 which is attached to trough 10 and aligned so that the bottom wall 14 of trough 10 will allow water to flow from, to and down chute portion 16. Chute portion 16 extends downward and away from bottom wall 14 of trough 10. Chute portion 16 contains outlet 17 which allows attachment of downspout connector 18 and connection of a downspout 20 to channel 11. Channel 11 further includes open end 19 at the lower end of channel 11 opposite the upper end attached to trough 10. Open end 19 provides for exit of blocking debris from channel 11. FIG. 2 shows a side view of trough 10 and channel 11.

When used in guttering, a channel constructed in accordance with the instant invention is affixed to a trough as explained, and a downspout is attached to outlet 17 of channel 11. It may be desirous to use some elbows (not shown) in order to allow the downspout to be flush against a structure and aligned under trough 10. During use of the guttering, rain and debris will enter trough 10 and flow toward the lowest point. As in normal guttering systems, the downspout should be positioned at the lowest points of the troughs. Similarly the device of the instant invention should be connected at the lowest points of the troughs. The chute is affixed so that water runs out of the trough and downward. The water will then enter outlet 17 and pass through it to the downspouts. Blocking debris, however, will be carried further through channel 11 and down chute 16 and be ejected through open end 19 of channel 11.

While some debris or solid particles will obviously still pass through outlet 17, they generally do not cause blockage of downspout since they are small enough to pass freely through the downspout. The blocking debris or larger solid matter will not fit through outlet 17 and will thus pass over outlet 17 and exit from channel 11. Outlet 17 should be positioned along chute 16 so that it is displaced from open end 19 so that water does not flow past outlet 17 to a great extent. In usual rainfall situations, substantially all of the water will pass through outlet 17 and into the downspout. In overload situations, some water might continue past outlet 17 and through opening 19, however such situations are rare and cause little inconvenience. Said inconvenience is more than made up by the object of the instant invention, that is to reduce or eliminate blocking of downspouts.

While chute 16 is shown to have an angle of a certain characteristic in the drawings, the chute may extend at different angles for different flow rates of use. Also while chute 16 is shown having a horizontal portion 20, the angle of the chute may vary as may the placement of the outlet 17 within the chute. However, it is always necessary that the part of chute portion 16 that is attached to trough 10 extend downwardly from the bottom wall 14 of trough 10 in order to allow the water from trough 10 to drain effectively.

Thus it is apparent that there has been provided in accordance with the invention a device that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A device for use with guttering, troughs and downspouts which collect water and blocking debris, including:

a channel having a trough end and an open end including a chute portion and a pair of side walls capable of being attached to a trough so that said chute portion is aligned with the bottom of said trough and said chute portion slopes downward and away from said trough at its attachment to said trough and said pair of side walls are connected to the front wall of said trough so as to allow water to flow from said trough to said channel; and, an outlet located in said chute portion of said channel capable of conducting water from said channel to a downspout, said outlet being disposed between said trough side of said channel and said open end of said channel, wherein said channel and said outlet when used in guttering between said trough and said downspout allow water to be collected by said trough, flow to said channel, flow down said chute, flow into said outlet and then flow through said downspout, while also allowing blocking debris to pass through said channel over said chute, over said outlet and out said open end of said channel while bypassing said downspout.

2. A device as in claim 1 wherein said outlet is displaced inwardly from said open end of said channel by at least 1 inch.

3. A device as in claim 1 wherein said chute portion of said channel has a horizontal section at a point lower than said trough.

4. A device as in claim 3 wherein said outlet is placed at the point where said chute portion of said channel changes its slope from downward to horizontal.

5. A device as in claim 3 wherein said outlet is positioned in the horizontal portion of said chute portion of said channel.

6. A device as in claim 5 wherein said outlet is positioned immediately next to the downward sloping portion of said chute portion of said channel.

7. A device as in claim 1 wherein said channel additionally includes a portion of trough affixed to its upper end so as to allow fastening to a matching trough.

8. A device as in claim 1 wherein said channel additionally includes a downspout connector affixed to said outlet.

9. A device for use with a trough and downspout comprising a channel which is affixed at its upper end to the side of a trough and which is affixed at its lower surface to the top of a downspout, said channel further including:

an upper opening at said channel's upper end which is suitable for allowing drainage of said trough so that the lowest surface of the trough may drain into said channel;

a lower opening at said channel's lower end which allows drainage other than through a downspout for blocking debris from substantially the lowest surface of said channel; and, an outlet for said downspout interposed between said upper and lower openings which allows drainage into said downspout and exit of blocking debris through said lower opening in said channel.

10. A device as in claim 9, wherein said channel has a predetermined average width and said outlet is contained in a substantially horizontal surface which is substantially the lowest draining surface of said channel, wherein said outlet is disposed from said downspout opening by a distance approximately equal to the average width of said channel and wherein said channel is sloped upwardly from the side of said outlet opening opposite said lower opening upwards to said upper opening.

11. A device as in claim 9 wherein said channel additionally includes a portion of trough affixed to its upper end so as to allow fastening to a matching trough.

12. A device as in claim 9 wherein said channel has an average width substantially equal to the width of said gutter.

13. A device as in claim 9 wherein said channel additionally includes a downspout connector affixed to said outlet.

* * * * *